US008206208B2

(12) United States Patent
Ekisheva et al.

(10) Patent No.: US 8,206,208 B2
(45) Date of Patent: Jun. 26, 2012

(54) METHOD AND SYSTEM FOR PLAYING A LOTTERY GAME WITH ENHANCED MULTIPLIER FACTOR

(75) Inventors: Svetlana Ekisheva, Atlanta, GA (US); Charles Boykin, Alpharetta, GA (US); Amy Hill, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 579 days.

(21) Appl. No.: 12/409,595

(22) Filed: Mar. 24, 2009

(65) Prior Publication Data

US 2009/0239605 A1 Sep. 24, 2009

Related U.S. Application Data

(60) Provisional application No. 61/038,883, filed on Mar. 24, 2008.

(51) Int. Cl.
*A63F 6/24* (2006.01)

(52) U.S. Cl. ..... 463/17; 463/22; 463/25; 463/42; 273/139; 273/138.1

(58) Field of Classification Search ..... 463/17, 463/20, 22, 25, 42; 273/139, 138.1
See application file for complete search history.

(56) References Cited

U.S. PATENT DOCUMENTS

| | | | | |
|---|---|---|---|---|
| 5,613,679 | A | 3/1997 | Casa et al. | |
| 6,416,408 | B2 | 7/2002 | Tracy et al. | |
| 6,648,753 | B1 | 11/2003 | Tracy et al. | |
| 6,692,354 | B2 | 2/2004 | Tracy et al. | |
| 6,969,318 | B1 | 11/2005 | Packes, Jr. et al. | |
| 7,204,756 | B2 * | 4/2007 | Jubinville et al. | 463/17 |
| 7,513,825 | B2 | 4/2009 | Packes, Jr. et al. | |
| 7,641,548 | B2 | 1/2010 | Packes, Jr. et al. | |
| 2002/0151342 | A1 | 10/2002 | Tracy et al. | |
| 2004/0266514 | A1 | 12/2004 | Penrice | |
| 2005/0014552 | A1 | 1/2005 | Packes, Jr. et al. | |
| 2006/0205476 | A1 | 9/2006 | Jubinville | |
| 2006/0217181 | A1 | 9/2006 | Jubinville | |
| 2006/0246995 | A1 * | 11/2006 | Packes et al. | 463/17 |
| 2009/0137305 | A1 * | 5/2009 | Luciano et al. | 463/19 |

FOREIGN PATENT DOCUMENTS

WO WO 03/089074 10/2003

(Continued)

OTHER PUBLICATIONS

PCT Search Report, Jul. 22, 2009.

(Continued)

*Primary Examiner* — Ronald Laneau
*Assistant Examiner* — Wilner Jean Baptiste
(74) *Attorney, Agent, or Firm* — Dority & Manning, P.A.

(57) ABSTRACT

A system and methodology for conducting a lottery wagering game include receiving a first wager fee from players for entry in a primary game. The players are offered the option to pay a second wager fee for a chance at a first multiplier fact that may increase the prize award for winners of the primary game. The players are also offered the option to pay a third wager fee for a chance at a second multiplier factor that combines with the first multiplier factor in a predetermined for subsequently randomly generated multiplier function to determine a final multiplier factor that is applied to the prize award for winners of the primary game.

13 Claims, 3 Drawing Sheets

FOREIGN PATENT DOCUMENTS

WO WO 2005/039711 5/2005

OTHER PUBLICATIONS www.oregonlottery.org—Oregon Lottery, Oregon'S Game Megabucks.

Maryland State Lottery—Keno Bonus Animation.

Article—Georgia Powerball, Confusion or Cash Awaits Game Players, the Atlanta Journal and the Atlanta Constitution, Sep. 2, 1995.

Article—Powerball Winners Could Double Prizes, Catoosa County News, Sep. 6, 1995.

* cited by examiner

METHOD AND SYSTEM FOR PLAYING A LOTTERY GAME WITH ENHANCED MULTIPLIER FACTOR

PRIORITY CLAIM

The present application claims priority to U.S. Provisional Application Ser. No. 61/038,883, filed Mar. 24, 2008.

FIELD OF THE INVENTION

The present invention relates to a system and method for conducting a lottery game, and more particularly to lottery games wherein a prize award is multiplied by a randomly generated factor.

BACKGROUND

Lottery or wagering games are well known wherein players place a wager on the outcome of an event, such as a random selection of numbers, objects, or other indicia, and the wager is won or lost depending on the outcome of the event. For example, in a typical lottery game such as a Pick-3 or Pick-4 game, entrants may place a wager and designate particular picks from a field of numbers or other indicia. Alternatively, the player may opt for random generation of their picks. The gaming authority then randomly generates (i.e., by mechanical, electrical, software generation, and the like) a "winning" set of numbers from the field, and a player "wins" if their picks match all or some combination of the winning numbers.

Bonus features have been introduced into lottery games to make the games more attractive to players. In a typical scenario, the player purchases the bonus feature option upon placing their initial wager for the lottery game. If the player wins a prize amount in the game, the bonus feature may increase the prize amount by a predetermined factor, or a randomly generated factor that is determined at the time of the lottery game. A well know version of this concept is the Powerball® lottery game with the Power Play option.

Powerball® is a lottery game with a combined large jackpot game and a cash game. Each ticket costs $1. Five white balls out of a drum with 55 numbered balls and one red ball out of a drum with 42 numbered red balls are drawn by the gaming authority. Players win by matching one of nine possible winning combinations. The jackpot is won by matching all five white balls in any order and the red PowerBall®. The second cash prize is won by matching five white balls in any order. A player also wins a cash prize any time they match the red PowerBall®. The Power Play option is a special feature that allows a winner to multiply the original prize amount by 2, 3, 4 or 5 times (does not include the jackpot). The gaming authority picks the Power Play multiplier number at random at each lottery draw. A player must choose the Power Play option when they buy their Powerball® ticket, and then the ticket must win one of the non-jackpot prizes before the multiplier takes effect.

U.S. Pat. Nos. 6,416,408; 6,648,753; and 6,692,354 describe various group wagering games wherein entrants make a first wager on a first game and a second wager on the outcome of a second group game. The outcome of the second group game is determined first, but is only applied if the first game is a winner. Thus, a "bonus" round of play is provided for winners of the first game.

The industry is continuously seeking ways, such as the bonus or multiplier features described above, to generate group interest and excitement in the gaming experience. The present invention provides a unique bonus feature and associated system in this regard.

SUMMARY

Objects and advantages of the invention will be set forth in part in the following description, or may be obvious from the description, or may be learned through practice of the invention.

In accordance with aspects of the present invention, a methodology and associated system are provided for conducting a lottery wagering game of the type wherein the game is presented to a plurality of players, typically via remote lottery terminal locations at retail establishments, convenience stores, and so forth. The game is generally coordinated and controlled by a central gaming authority via a central computer control system. In the course of the game, players place a first wager for entry into a primary game. The type or theme of the primary game is not a limiting factor of the invention, and may be, for example, a Powerball® or other type of game wherein players select a set of numbers or objects from a defined field (or opt to have the set randomly generated for them with a "quick-pick" option). At a scheduled drawing time, the gaming authority randomly selects a winning set from the same field, and winning hands are a function of the number and combination of matches between the players' set of numbers or objects and randomly selected winning set.

The game also provides an option for players to pay a second wager fee for a chance at a first multiplier factor that increases the prize award for winners of the primary game. For example, players may pay a fee to select a first multiplier factor number or object from a defined field, and if their factor is randomly selected by the gaming authority, their prize award (if applicable) for winning a component of the primary game is multiplied by the first multiplier factor. A non-limiting example of this feature may be, for example, the Power Play option in the conventional Powerball game.

The game also offers to players of the primary game who wagered on the first multiplier the option to pay a third wager fee for a chance at a second multiplier factor. In other words, this second multiplier factor option is only available to players that wager on the first multiplier factor. The option of the second multiplier factor adds an additional level of wagering excitement to the game and is attractive in that it can significantly increase the prize award. The second multiplier factor may also add a degree of "danger" to the wager in that it could actually decrease the prize award or first multiplier factor, which may be attractive to certain types of players.

The second multiplier factor is independently determined and combines with the first multiplier factor according to a function that results in a "final" multiplier factor. This final multiplier factor is applied to the prize award for winners of the primary game. As discussed in greater detail herein, the function may combine the multiplier factors, multiply the factors, or even result in a final multiplier factor that is less than the first multiplier factor.

In a particular embodiment, the player's first multiplier factor is randomly selected for or designated by the player from a range of possible factors at the time the player places their wagers for the primary game and first multiplier factor option, for example when the player purchases the lottery ticket at a remote lottery terminal. If the player opts for the second multiplier factor, an additional fee is paid and the player's second multiplier factor is randomly selected for or designated by the player from a range of possible factors at the time of purchasing the ticket. The winning first multiplier factor and second multiplier factor may be randomly generated by the gaming authority from the range of possible factors at the drawing for the primary game.

The function for combining the first and second multiplier factors may be predefined by the gaming authority and known to the players at the time of purchasing their lottery tickets in one particular version of the game. For example, a published game rule may be that the winning multiplier factors are added to determine the final multiplier factor, or multiplied to determine the final multiplier factor.

In a particularly unique embodiment, the function for determining the final multiplier factor is randomly generated from a field of possible functions, for example at the time of conducting the primary game, such that players who have wagered on the first and second multiplier factors are not aware of the final multiplier factor until the primary game is concluded. The field of possible functions may include one or more functions that result in a final multiplier factor that may be less than the first multiplier factor. For example, the randomly generated function may dictate that the second multiplier factor is subtracted from the first multiplier factor, or that the lesser of first and second multiplier factors is the final multiplier factor.

To induce players to wager on the second multiplier factor despite the fact that it may result in a decreased final multiplier factor, an incentive will obviously be necessary. This incentive may the chance for a significant increase of the prize award. For example, in "double-or-nothing" type of wager, the second multiplier factor may result in either a doubling (or some other factor) of the first multiplier factor, or a loss of the first multiplier. Variations of this theme may be readily devised.

The invention also encompasses any manner of system configuration for implementing the enhanced multiplier factor game. For example, such a system may include a central gaming authority control system configured for conducting the primary game with a plurality of players, for example via any number of remote lottery terminals. Means are provided for players to wager on the primary game, as well as the first multiplier factor. Such means may similar to any conventional lottery system used to conduct Powerball® or similar types of games.

Means are also provided for offering to the players in the primary game an option to pay an additional wager fee for the second multiplier factor. This means may be the same as that provided for the first multiplier option, or another method or device. For example, the player may indicate the option or the same play slip used to enter the primary game.

Means are provided for generating the player's second multiplier factor independently from the first multiplier factor. This means may simply be a play slip option that allows the player to select their factor from a defined field, or the player may opt to have their factor randomly generated by the control system.

The winning first multiplier factor is randomly determined by the gaming authority by any conventional random selection device, such as a mechanical device that randomly selects an object from a randomly intermixed dispersion of objects, or a software program that randomly generates the factor. The winning second multiplier factor is randomly and independently determined in a separate event such that selection of the first winning multiplier factor has no influence on the random generation of the winning second multiplier factor. The winning second multiplier factor may be randomly determined by the same method or device used to determine the first multiplier factor, or a completely different means. For example, the first winning multiplier factor may be randomly determined in a "popcorn" type of random mechanical generator wherein a numbered ball is randomly selected from a blowing dispersion of balls. The second winning multiplier factor may be determined in a subsequent event with the same type of machine.

As mentioned, the function for combining or relating the first and second multiplier functions may be predefined as a game rule by the gaming authority such that the function is known to the players at the time of wagering on the primary game. However, in a particularly unique system configuration, multiple functions are possible, each with a different resulting total multiplication factor. In this scenario, a mechanical or software implemented random selection device may be used and interfaced with the central control system for selection of the function used to determine the final multiplier factor.

In an unique embodiment that may provide entertainment value, the respective random selection devices are different for each of determining the winning first multiplier factor, the winning second multiplier factor, and the combining function.

Additional aspects of the methodology and system are discussed in greater detail below by reference to particular non-limiting embodiments illustrated in the drawing.

DETAILED DESCRIPTION

Figure 1:
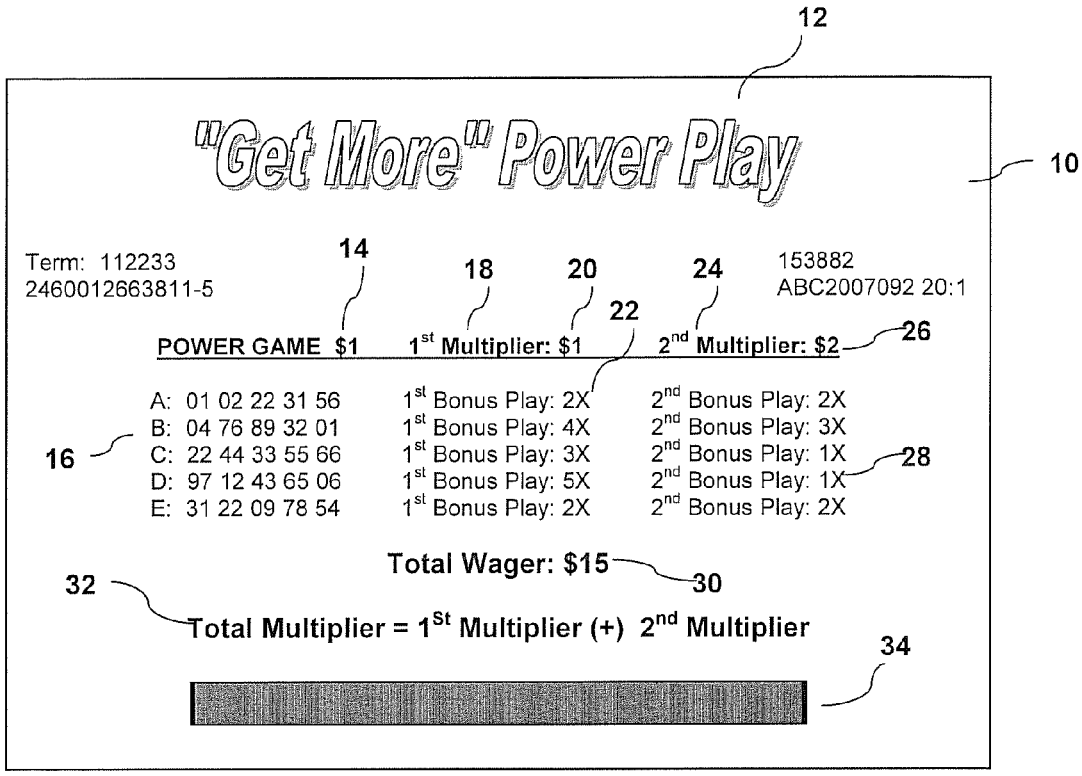
FIG. 1 is a perspective view of an embodiment of a lottery ticket implementing aspects of a lottery game in accordance with the invention.

Reference will now be made in detail to embodiments of the inventive methods and systems, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the present invention include these and other modifications and variations as come within the scope and spirit of the invention.

Various embodiments of a lottery wagering game of the type wherein a primary game is presented to a plurality of players are represented by the lottery tickets 10 in FIGS. 1 through 4. Typically, the players place a wager to enter the primary game and the lottery tickets 10 are distributed via remote lottery terminal locations at retail establishments, convenience stores, and so forth, as described in greater detail below by reference to the system in FIG. 5. The primary game is not a limiting factor and may be any one or combination of games. In particular embodiments, the primary game is one wherein players select a set of numbers, indicia, or objects from a defined field, such as in a conventional PowerBall® or similar game. The players may opt to have their "hand" randomly generated via a "quick-pick" option, as is commonly understood in the art.

In the lottery tickets 10 embodied in FIGS. 1 through 4, the primary game is indicated by indicia 12 and refers to a type of game having enhanced "power play" or multiplier features. In particular, the primary game consists of the players paying a wager 14 for a hand or set of player indicia. In the illustrated tickets 10, the wager is $1.00 for each set of player indicia 16, and the player has wagered on five different hands (A through E). The selection of the player indicia may be through a conventional play slip that is filled out by the player and submitted to a clerk or other person at the remote lottery terminal. The play slips are read by a scanner at the terminal, and the lottery tickets 10 are printed directly at the terminal. In an alternative embodiment, the player's selections may be manually input via a keypad or like device at the terminal. As mentioned, the players may be provided with the option to have their hands 16 (A through E) randomly generated, as is commonly understood in the art.

At a scheduled drawing time for the primary game, the gaming authority randomly selects a winning set of the numbers, objects, or other indicia from a defined field. Winning hands typically are a function of the number and combination of matches between the player's sets (A through E) and the randomly selected winning set according to game roles, payout schedules, and the like, established by the gaming authority.

The game also provides an option for players to pay a second wager fee for a chance at a first multiplier factor 22 or "bonus" that may increase the prize award for winners of the primary game. Referring to the various tickets 10 in the illustrated embodiments, indicia 18 of any manner is provided on the lottery ticket that references, describes, or otherwise displays the first multiplier option, as well as the wager fee 20 for this option. In the illustrated embodiment, the wager fee is $1.00 per bonus play for each of the hands A through E. With this option, players may pay the designated fee to select a first multiplier factor number or object from a defined field or range. For example, the players may select a multiplier factor 22 from the field of 2× through 5×. In an alternative embodiment, the players may opt to have the multiplier factor 22 randomly generated for the individual hands. At the time of the drawing of the primary game, the first multiplier factor is also determined, for example by random generation. If the first multiplier factor selected or randomly assigned to one of the player's hands is the factor established by the gaming authority, the prize award for the hand (if applicable), or a portion of the award, is multiplied by the multiplier factor. For example, referring to FIG. 1, the player's hand B indicates a first bonus play of "4×". If hand B generates a primary game prize award, then the prize amount (or some portion thereof) may be multiplied by a factor of 4 to generate an increased total prize amount. Again, an embodiment of such a feature corresponds to the Power Play option in the well known PowerBall® game.

The game also offers to players of the primary game who have wagered on the first multiplier the option to pay a third wager fee 26 for a chance at a second multiplier factor 28. The second multiplier factor may be indicated, described, or otherwise presented to the player by any manner of indicia 24 on the lottery ticket 10 or corresponding play slip. In the illustrated embodiment, the second multiplier factor 28 requires a fee of $2.00 for each hand played. The second multiplier factor option is only available to players that wager on the first multiplier factor. The option of the second multiplier factor 28 adds an additional level of wagering excitement to the game and is attractive in that it can significantly increase the prize award, depending on the relationship or function between the first and second multiplier factors. As described in greater detail below, the second multiplier factor may also add a degree of "danger" to the wager in that it could actually decrease the prize award or first multiplier factor, which may also be attractive to certain types of players.

The second multiplier factor 28 may be independently determined, for example by any manner of random generator device or method, and "combines" with the first multiplier factor 22 in a function that results in a final multiplier factor. This function may vary between different games. In the embodiment illustrated in FIG. 1, the function between the first and second multiplier factors is the addition of the factors to yield a total multiplier factor, as indicated to the players by indicia 32. For example, referring to hand A in ticket 10 of FIG. 1, the first multiplier factor is 2× and the second multiplier factor is 2×. If hand A is a winner in the primary game and the first and second multiplier factors are also matched, then the total multiplier factor to be applied to the appropriate prize award is the sum of the first and second multiplier factors to yield a total prize of 4 times the prize award.

It should be readily appreciated that the relationship or function between the different multiplier factors 22, 28 may vary widely within the scope and spirit of the invention. The function may combine the multiplier factors, multiply the factors, subtract the factors, or even result in a final multiplier factor that is only equal to the first multiplier factor, or even less than the first multiplier factor.

As with the first multiplier factors 22, the second bonus play or multiplier factors may be selected by the players from a defined field of factors, or the player may opt to have the factor randomly generated from the defined field.

Figure 2:
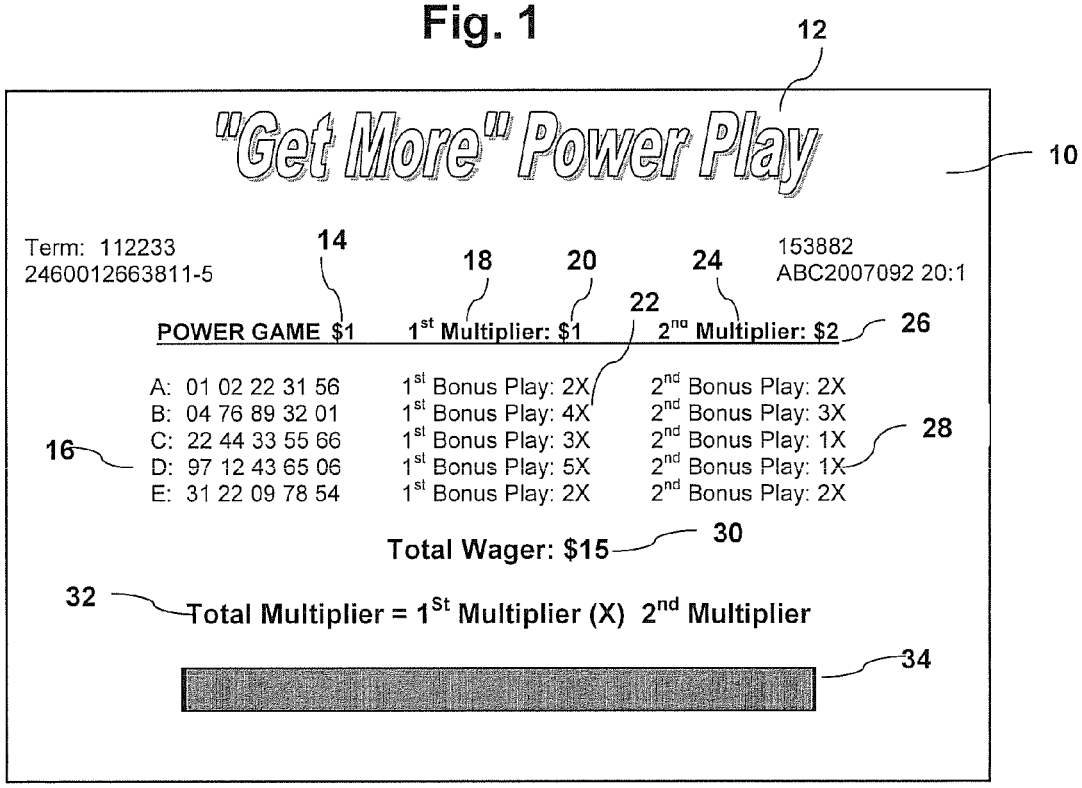
FIG. 2 is a perspective view of a different embodiment of a lottery ticket implementing aspects of a lottery game in accordance with the invention.

In the embodiment of FIG. 2, the total multiplier 32 is a function of multiplication of the first and second multiplier factors. For example, referring to hand D, the first bonus play multiplier factor 22 is 5× and the second bonus play multiplier factor 28 is 1×. The total multiplier for a prize award for hand D would thus be 5×, or five times the prize award.

Figure 3:
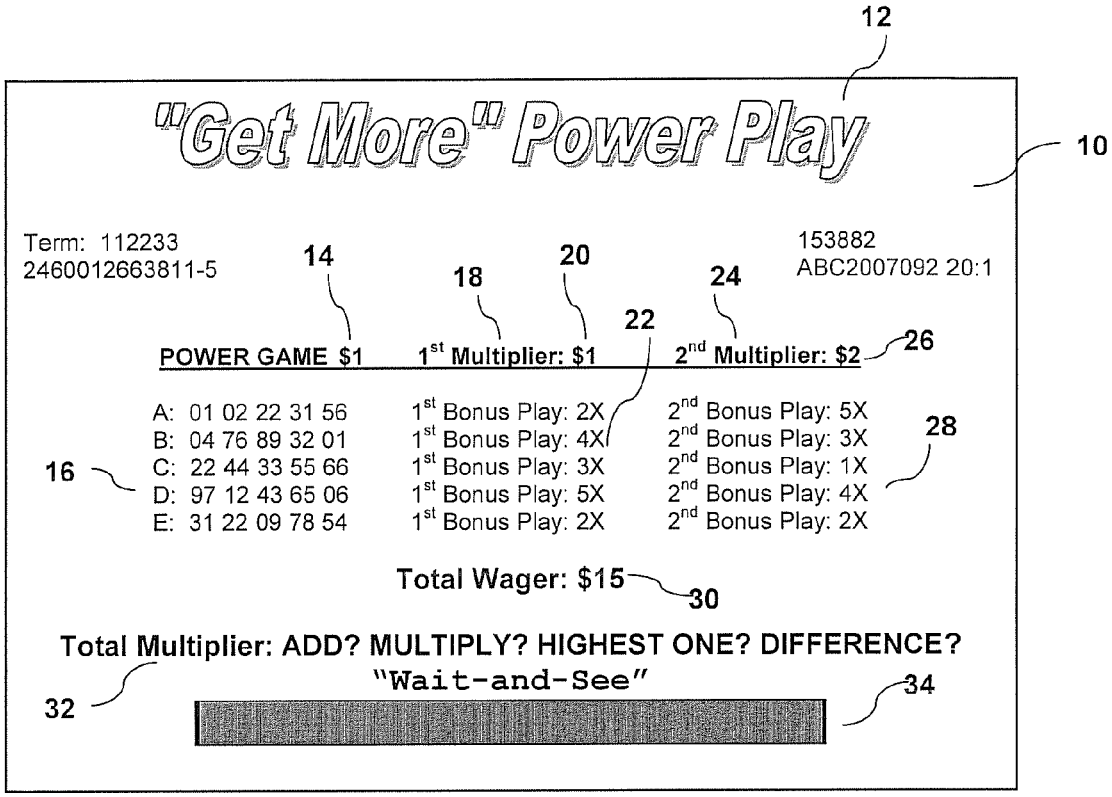
FIG. 3 is a perspective view of still another embodiment of a lottery ticket implementing aspects of a lottery game in accordance with the invention.

FIG. 3 illustrates a unique embodiment wherein the function for the total multiplier 32 is unknown to the player until the time of the primary game drawing, and is designated on the lottery ticket 10 as a "Wait-and-See" feature. In this embodiment, the factors 28 may be randomly generated or selected by the player, as discussed above, but the combination or relationship between the first and second multiplier factors remains a mystery to the player until the time of the drawing. For example, at the time of the primary drawing, a multiplier function drawing may also be conducted wherein the function is randomly generated from a field of possible functions. This field of functions may include an addition function, multiplication function, difference function, highest factor function, and so forth. This game may be particularly exciting to certain players. For example, referring to hand D of the ticket 10 of FIG. 3, the first bonus play multiplier function 22 is 5× and the second bonus play multiplier function 28 is 4×. In an addition function, a total multiplier factor of 9× would be generated. In the multiplication function, a total multiplier factor of 20× could be generated. However, in a difference function, a total multiplier factor of 1× may be generated. This possibility of having an extremely high or extremely low multiplication factor may be appealing to certain players.

Figure 4:
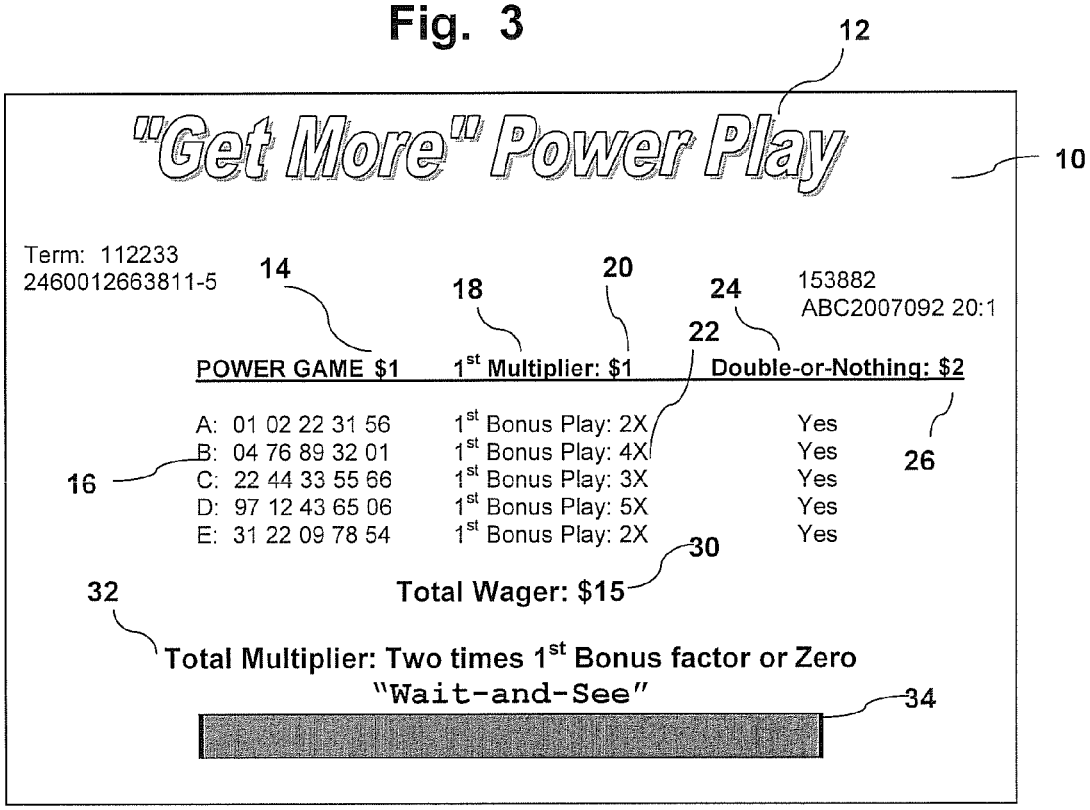
FIG. 4 is a perspective view of yet another alternative embodiment of a lottery ticket implementing aspects of a lottery game in accordance with the invention.

FIG. 4 illustrates another embodiment of a "Wait-and-See" game referred to by indicia 24 as a "double-or-nothing" factor option. With this game, the player simply purchases the option for the wager amount 26. In the ticket 10 illustrated in FIG. 4, the player purchased the option for each hand A through E, as indicated by the "yes" mark at each corresponding hand position. With this game, the function is known to the player, but the outcome is not known until the primary drawing. For example, the player recognizes that the first bonus play may be doubled (or some other factor), or the first multiplier factor may be lost completely. For example, referring to hand B of the primary game, the first bonus play multiplier function is 4× and the player opted for the double-or-nothing multiplier factor. At the time of the primary game drawing, the double-or-nothing result is randomly selected. Assuming that hand B is a winner and the first multiplier factor 22 was also matched, if the double function is randomly generated, then the first multiplier function 22 (4×) is doubled (8×) any prize award for hand B is increased 8 fold. However, in the same situation, if the "nothing" result is generated for the second multiplier factor, then the player loses any multiplication of the prize award. To induce players to wager on the second multiplier factor despite the fact that it may result in a decreased final multiplier (i.e., no multiplier) factor, an incentive will obviously be necessary. This incentive may be the chance for a significant increase of the prize award. Obviously, variations of this theme are readily devised by those skilled in the art and are within the scope and spirit of the invention.

Figure 5:
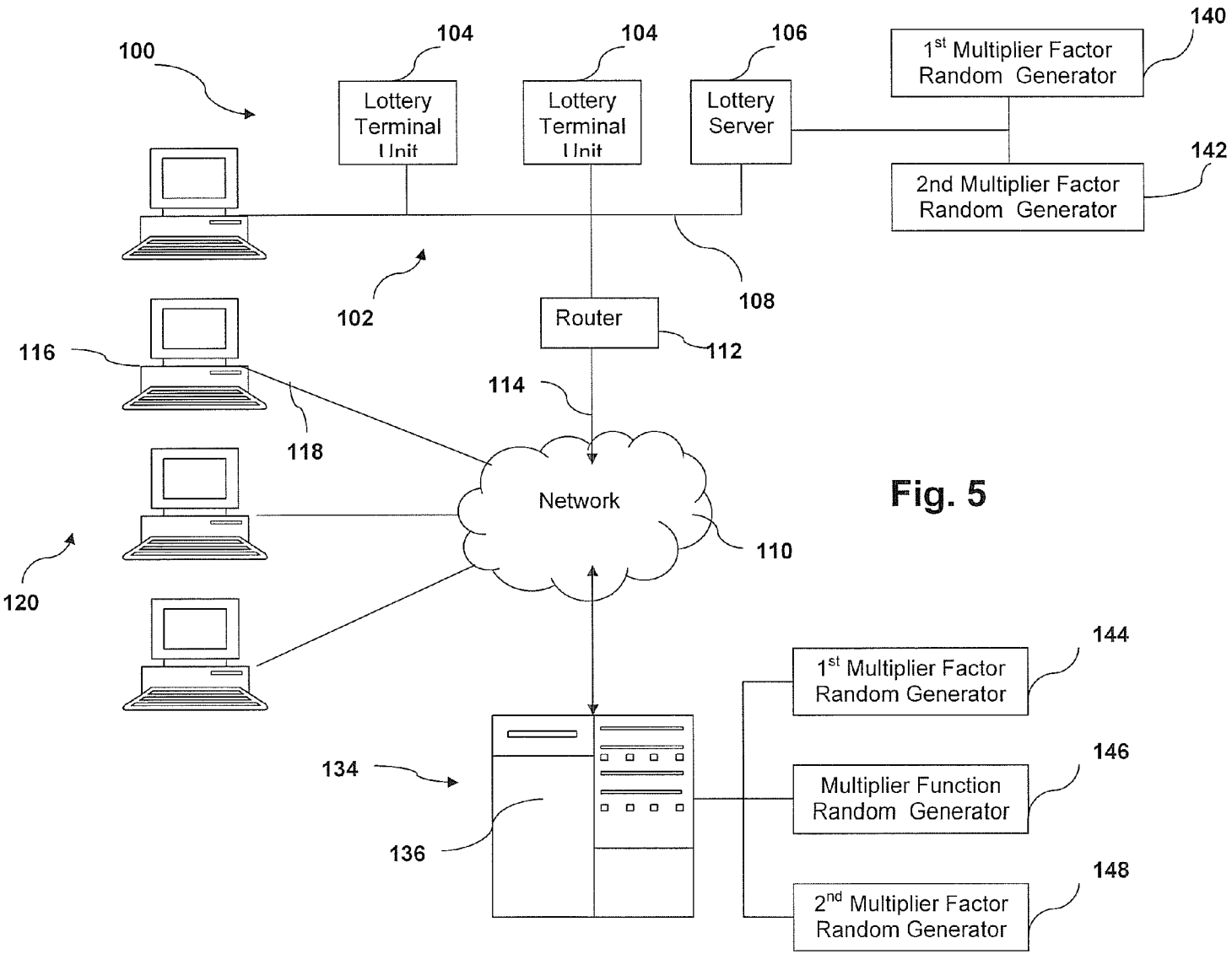
FIG. 5 is a diagrammatic view of a system in accordance with aspects of the invention.

FIG. 5 is a diagram of a system in accordance with exemplary features of the invention is illustrated that may be used to implement lottery games as described above. Referring to FIG. 5, a lottery network 100 may include a first group or network 102 of lottery terminal units 104 operatively coupled to a central lottery network computer or server 106 via a network data link or bus 108. The lottery network 100 may be coupled to a network 110, which may be, for example, the Internet, a wide area network (WAN), or a local area network (LAN) through a network hub or router 112 via a first network link 114. In one possible configuration, the first network 102 may be a state lottery system operating within an individual state or region of states. In this configuration, the individual lottery terminal units 104 may be interconnected to a central system for tracking and coordination of the lottery game over a wide geographic region. The central system may be implemented by the gaming authority, such as a state lottery system commission.

The lottery network 100 may further include other lottery terminal units 116 that may be directly connected to the network 110 through a plurality of direct network links 118, thereby eliminating the need for the bus 108, router 112 or other networking equipment. Each lottery terminal unit 116 in this configuration may represent a group of lottery retailers participating in the state lottery, or a plurality of the lottery terminal units 116 may be grouped together to form a lottery node 120. The lottery nodes 120, in turn, may be directly connected and/or multiplexed to the network 110 via the direct network links 118. Further, the direct network links 118 may represent secure communications channels physically hardened against tampering and/or the communications may be encrypted to prevent unauthorized access to information transmitted thereon.

The individual lottery terminal units 104 may be of conventional design and configured with functionality to allow a user to enter the information required for players to participate in the lottery game. The lottery terminal unit 104 may include a housing and one or more input devices, which may be, among other things, a control panel having a plurality of input keys, a display, a value input device such as a card reader, a lottery play slip or ticket reader, and a lottery play ticket printer. Examples of these functional features are well known to those skilled in the art and need not be described in detail herein.

In a particular embodiment, the player will enter their selection for the primary game, as well as their option and/or selections for the first and second multiplier factors (and any other desired input information) via a play slip that is subsequently read by a play slip reader incorporated in the lottery terminal 104. In addition, input keys may allow the player or sales person to select the game to be played, input the value to be wagered, manually enter the selected lottery characters, and input any other information necessary to play a given lottery game. The lottery terminal unit 104 typically includes a display that may be a LCD, a CRT, a touch-screen capable of receiving and displaying information, or any other suitable device capable of displaying the information input via the input keys, the lottery play slip reader or the touch-screen input.

The value input device may include any device that can accept value or a wager from a customer, such as a magnetic card reader or an optical currency collector. The value input device may further be integrated with external devices, such as cash registers or other retail terminals, communicatively connected to the lottery terminal unit 104, to exchange information necessary to receive and record the wagering transactions.

The terminal 104 incorporates a lottery ticket printer that may be used to print or otherwise encode lottery tickets, as described above, with information selected or required to play a the primary game with multiplier factor options.

The network 110, and hence the individual lottery terminal units 104, 116, may be communicatively connected to a central host 134. The central host 134 may be a single networked computer, or a series of interconnected computers having access to the network 110 via a gateway or other known networking system. Generally, the central host 134 may include a central lottery computer 136 configured to manage, execute and control the individual lottery terminals 104, 116 and the routines used to play the various lottery games. The central lottery computer 136 may include a memory for storing lottery programs and routines, a microprocessor for executing the stored programs, a random access memory and an input/output bus. These components may be multiplexed together via a common bus, or may each be directly connected via dedicated communications lines, depending on the needs of the lottery system.

In operation, the central lottery computer 136 may operate as a clearing-house for the lottery terminal units 116 and the first lottery network 102, whereby the lottery network computer 106 collects, stores and analyzes status and operational information relating to each lottery terminal unit 104. For example, the lottery network computer 106 may continuously receive transactional data from the individual lottery terminal unit 104 indicative of the number of tickets sold and associated dollar amounts, and the lottery numbers and number order generated at each lottery terminal unit. The transactional data collected by the lottery network computer 106 may be communicated to the central host 134 continuously or may be processed into a batch format and transmitted periodically for storage in a database. If, for example, the central lottery computer 136 and the lottery network computer 106 are communicating continuously, it may be desirable for the central lottery computer 136 to execute the actual lottery routine and transmit the results to the lottery network computer 106 for distribution to the lottery terminal units 104 and directly to the lottery terminal units 116.

As described above, a system for implementing the game methodology will incorporate the ability to randomly generate certain values at the appropriate time, depending on a particular game. For example, in the system of FIG. 5, the players may have the option to have their first and second multiplier factors randomly determined by the system. In this regard, means 140, 142 may be implemented at the individual terminal units 104 via the server/computer 106, or directly interfaced with the terminal units. Upon drawing or playing the primary lottery game, the system implements means for randomly and independently determining winning first and second multiplier factors 144, 148 interfaced within the overall system so that at the time of the primary lottery game draw, the winning multiplication factors are also randomly selected. Similarly, for games wherein the multiplier function is not pre-established by the gaming authority, a means 146 is used to randomly select the function at the time of the primary lottery game draw.

These random event generator devices 140, 142, 144, 146, 148 may be implemented by combination of suitable electronic, mechanical, or manual device. For example, a random number generator may be employed in the form of a mechanical device configured to randomly select an object from a group of randomly interspersed objects. An example of this type of device may be a conventional blower-type apparatus adapted for use with ping-pong balls on which indicia are printed, for randomly generating the indicia. A manual or mechanical display can be used at one or more locations to display the drawn indicia so that group of players in the primary game can monitor the progress of the game, as well as the selection of the first and second multiplier factors, and multiplier function is applicable.

Any manner of electronic device may be used to randomly select an object from a group of electronically randomized objects. An example of this type of device may be an electronic roulette-type wheel, and the like.

It should also be appreciated that the random generation events may be implemented by software programs under the control of the central computer 136. For example, the same type of software implementation used to randomly generate a player's selection for the primary lottery game (i.e., a quick-pick for a Powerball game) may be used to generate the player's multiplier factors from defined field.

The random generator devices or methods may be the same or different for each event requiring a randomly generated factor or function. It may be desired from an entertainment aspect for each random generation event to be determined by a different means, and for such means to be publicized (i.e., televised) to the gaming public.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A computer-implemented method for conducting a lottery wagering game, comprising:

with a central host computer in communication with a plurality of lottery terminals via a network, performing the following:

receiving a first wager fee from players for entry in a primary game;

offering to the players in the primary game the option to pay a second wager fee for a chance at a first multiplier factor that increases the prize award for winners of the primary game;

offering to players in the primary game the option to pay a third wager fee for a chance at a second multiplier factor, the second multiplier factor combining with the first multiplier factor in a function to determine a final multiplier factor that is applied to the prize award for winners of the primary game;

wherein the primary game is conducted and the prize award in the primary game is granted to winners of the primary game regardless of whether or not the players opted for the first or second multiplier factors; and wherein the combination function for determining the final multiplier factor is randomly generated from a field of possible functions at the time of conducting the primary game such that players who have wagered on the first and second multiplier factors are not aware of the final multiplier factor until the primary game is conducted.

2. The method for conducting a lottery wagering game as in claim 1, wherein the player's first multiplier factor is randomly selected for or designated by the player from a range of possible factors at the time the player places their wagers for the primary game and first multiplier factor option, the winning first multiplier factor being randomly selected from the range of possible factors.

3. The method for conducting a lottery wagering game as in claim 2, wherein the player's second multiplier factor is randomly selected for or designated by the player from a range of possible factors at the time the player places their wagers for the primary game and first and second multiplier factor options.

4. The method for conducting a lottery wagering game as in claim 1, wherein the final multiplier factor may be less than or greater than the first multiplier factor depending on the combination factor for combining the first and second multiplier factors.

5. The method for conducting a lottery wagering game as in claim 1, where the combination function adds the second multiplier function to the first multiplier function.

6. The method for conducting a lottery wagering game as in claim 1, wherein the combination function multiplies the first and second multiplier functions.

7. The method for conducting a lottery wagering game as in game 1, wherein the winning first multiplier factor is randomly generated by the gaming authority from a range of possible factors, the winning second multiplier factor is randomly generated by the gaming authority from a range of possible factors, and the combination function of the first and second multiplier factors is randomly generated by the gaming authority and not known to the players at the time of placing their wagers.

8. A computer-implemented method for conducting a lottery wagering game, comprising:

with a central host computer in communication with a plurality of lottery terminals via a network, performing the following:

receiving a first wager fee from players for entry in a primary game;

offering to the players in the primary game the option to pay a second wager fee for a chance at a first multiplier factor that increases the prize award for winners of the primary game;

offering to players in the primary game the option to pay a third wager fee for a chance at a second multiplier factor, the second multiplier factor combining with the first multiplier factor in a function to determine a final multiplier factor that is applied to the prize award for winners of the primary game;

wherein the primary game is conducted and the prize award in the primary game is granted to winners of the primary game regardless of whether or not the players opted for the first or second multiplier factors;

wherein the combination function for determining the final multiplier factor is randomly generated from a field of possible functions at the time of conducting the primary game such that players who have wagered on the first and second multiplier factors are not aware of the final multiplier factor until the primary game is conducted; and wherein the second multiplier factor has one of a first or second value and the combination function of the first and second multiplier factors results in a final multiplier factor that is at least double the first multiplier factor, or results in no multiplier factor such that the prize award is not increased.

9. A system for implementing a lottery game with enhanced multiplier factor features, said system comprising:

a central control system configured for conducting a primary game with a plurality of players, including means for receiving a first wager fee from players for entry in the primary game;

means for offering to the players in the primary game an option to pay a second wager fee for a first multiplier factor that increases the prize award for winners of the primary game;

means for offering to players in the primary game the option to pay a third wager fee for a second multiplier factor;

means for generating a player's second multiplier factor independently from the player's first multiplier factor;

means for randomly and independently determining winning first and second multiplier factors;

means for combining the second multiplier factor with the first multiplier factor according to a function to determine a winning final multiplier factor that is applied to the prize award for winners of the primary game; and wherein said means for randomly and independently determining winning first and second multiplier factors comprises any combination of random selection devices configured to randomly select a number or object from a defined field of respective numbers or objects, said means for combining the second multiplier factor with the first multiplier factor further comprising a random selection device configured to randomly select the function for combining the multiplier factors from a defined field of possible functions, wherein the total multiplier factor may be less than or greater than the first multiplier factor depending on the selected function.

10. The system as in claim 9, wherein said means for offering the second multiplier factor option to players comprises a selection on a play slip used by players to play the primary game and wager on the first multiplier factor.

11. The system as in claim 9, wherein said means for randomly and independently determining winning first and second multiplier factors comprises the same random selection device.

12. The system as in claim 9, wherein said means for randomly and independently determining winning first and second multiplier factors comprises a different random selection device for each of the multiplier factors.

13. The system as in claim 9, wherein said random selection devices are different for each of determining the winning first multiplier factor, the winning second multiplier factor, and the combining function.

* * * * *